US005791062A

United States Patent [19]

Walker

[11] Patent Number: 5,791,062

[45] Date of Patent: Aug. 11, 1998

[54] QUILTING TEMPLATE

[76] Inventor: Jane Sarah Walker, 4337 West 14th Avenue, Vancouver, British Columbia, Canada, V6R 2X9

[21] Appl. No.: 633,457

[22] Filed: Apr. 17, 1996

[51] Int. Cl.[6] ..... B43L 13/20; A41H 3/00; G01B 3/00

[52] U.S. Cl. ..... 33/563; 33/1 B; 33/565

[58] Field of Search ..... 33/563, 1 B, 1 BB, 33/11, 12, 17 R, 562, 565, 566

[56] References Cited

U.S. PATENT DOCUMENTS

| | | | |
|---|---|---|---|
| 2,049,245 | 7/1936 | Breitbarth | 33/1 B |
| 3,061,946 | 11/1962 | Carty | 35/563 |
| 3,798,781 | 3/1974 | Wolfe | 33/563 |
| 4,589,210 | 5/1986 | Konrad | 33/27.03 |
| 4,608,939 | 9/1986 | Lampley | 112/260 |
| 4,779,346 | 10/1988 | Schafer | 33/1 B |
| 4,936,020 | 6/1990 | Neblett | 33/566 |
| 4,945,642 | 8/1990 | Saulietis | 33/17 R |
| 5,141,140 | 8/1992 | Moffett-Hall | 223/52 |
| 5,285,580 | 2/1994 | Christensen | 33/565 |
| 5,511,316 | 4/1996 | Fischer et al. | 33/562 |
| 5,557,996 | 9/1996 | Reber et al. | 33/563 |
| 5,604,988 | 2/1997 | Costelloe | 33/562 |

FOREIGN PATENT DOCUMENTS

| | | | |
|---|---|---|---|
| 2245815 | 1/1992 | United Kingdom | 33/565 |

OTHER PUBLICATIONS

Creative Curves Ruler (Virginia Walton) Keepsake Quilting p. 90, manufactured by Omnigrid, Inc. of Washington, U.S.A. prior to 17 Apr. 1996.

*Primary Examiner*—Christopher W. Fulton
*Attorney, Agent, or Firm*—Fetherstonhaugh & Co.

[57] ABSTRACT

A transparent flat sheet template facilitates joining and cutting of pieces of fabric used to make conventional quilting units, prior to assembly of the units into in a quilt. The template comprises a first edge having a first straight edge portion and a concave edge portion, the concave edge portion being a portion of a circle. The template has second and third straight edges disposed perpendicularly to each other, and a fourth edge disposed parallel to the second edge. The template also includes an arcuate guideline which is generally similar in size and shape to the concave edge portion, and a grid of first and second sets of straight guidelines marked on the template. The first set of guidelines are parallel to each other and to the first straight edge portion of the template. The second set of guidelines are parallel to each other and to the second edge of the template. The straight guidelines are used to align the template with edges of a square of fabric. The concave edge portion facilitates accurate centering of a fabric circle on the square of fabric, and the arcuate guideline facilitates accurate cutting of the sewn fabric circle and square of fabric to produce quilting units.

20 Claims, 6 Drawing Sheets

QUILTING TEMPLATE

BACKGROUND OF THE INVENTION

The invention relates to a transparent template to facilitate accurate positioning and cutting of pieces of fabric, particularly for making quilts.

Making quilts from small pieces of fabric of different colours and patterns, and arranged in different patterns, is well known. In the early days of quilting, the pieces of fabric were cut by hand using scissors, and sewn together by hand using needle and thread. Nowadays, most quilting is done using sewing machines, and the cutting and joining of the fabric pieces has been simplified somewhat using various quilting aids, such as straight edges, circular templates and transparent templates, some of the templates having guidelines marked on them to ensure accuracy of the many relatively small pieces of fabric.

A popular quilting pattern known as the "drunkard's path" utilizes a plurality of drunkard's path quilting units. These units are usually of equal size and of square shape, the squares having sides of between 3 and 5 inches (7.5 and 13 cm). Each quilting unit usually comprises two separate pieces of fabric of different colours and/or patterns, the first piece of fabric being a 90 degrees quadrant of a circle, and the second piece of fabric being complementary to the first piece to form with the first piece the square as above. In this way, the quilting unit has an overall square shape, in which one corner of the square is formed by two intersecting edges of the 90 degree quadrant. Clearly, overall appearance of the unit will vary depending on ratio of the radius of the quadrant to length of the side of the square. Each quilting unit is secured to adjacent generally similar units in a wide variety of patterns, producing an essentially unlimited number of designs of finished quilts.

It can be seen that, for a bed quilt measuring between about 68 and 94 inches (175 and 230 cms), with each unit being sewn from two separate pieces of fabric and having a size of between 3 and 5 inches (7.5 and 13 cm) the quilt can comprise several hundred pieces of fabric. Clearly, in order to ensure the quilt has a generally symmetrical appearance with a rectangular grid of intersecting straight edges of the squares, accuracy of cutting the individual fabric pieces and forming the units is essential. This must be then combined with accurate sewing together of the individual units, where there are few chances to correct errors which arose while making the units.

There have been many attempts to improve accuracy of cutting pieces of fabric to make quilts, some of which have been patented as below.

U.S. Pat. No. 4,779,346 (Schafer) discloses a template of a rectangular transparent sheet marked with a rectangular grid of lines and some oblique lines to assist in sewing, quilting etc. to achieve a selected patten.

U.S. Pat. No. 5,141,140 (Moffett-Hall) discloses a method and apparatus for creating fabric appliques consisting of a plate with an opening for receiving quilting material and a peripheral shape identical to that of the opening. The quilting material is placed between the template and the opening in the plate, leaving an edge of the quilting material exposed around the periphery of the template. U.S. Pat. No. 4,608,939 (Lampley) discloses a template for hand sewing to ensure equal spacing of stitches, and U.S. Pat. No. 4,945,642 (Saulietis) discloses a quilting template for guiding a cutting tool to assist in quilting operations.

None of the patents discussed above address problems that are addressed by the present invention.

SUMMARY OF THE INVENTION

The invention reduces the difficulties and disadvantages of the prior art by providing a transparent template which has edges and guidelines to facilitate positioning of small pieces of fabric prior to sewing, and for guiding a cutting tool, such as a rotary cutter, to accurately cut pieces of fabric which have been sewn together. The guidelines and edges ensure very accurate positioning and cutting, thus facilitating final sewing of quilting units into an accurately arranged quilt.

A transparent flat sheet template according to the invention comprises at least first, second and third edges and a first arcuate guideline. The first edge has a first straight edge portion and a first concave edge portion, the concave edge portion being a portion of a first circle. The second and third edges are connected together and cooperate with the first edge. The first arcuate guideline is similar in size and shape to the first concave edge portion. Preferably, the second edge is straight and disposed perpendicularly to the first straight edge portion and a fourth straight edge is straight and disposed parallel to the second edge.

The template further comprises a grid of first and second sets of straight guidelines marked on the template to assist in alignment of the template with pieces of fabric. The first set of straight guidelines are parallel to each other and to the first straight edge portion of the template, and the second set of straight guidelines are parallel to each other and to the second edge of the template.

In a preferred embodiment, the first edge has a second straight edge portion aligned with the first straight edge portion and disposed on a side of the first concave edge portion opposite to the first straight edge portion. In addition, the concave edge portion extends over 180 degrees of arc and the first arcuate guideline extends over 180 degrees of arc and intersects the third edge at two locations.

A detailed disclosure following, related to drawings, describes several embodiments of the invention which are capable of expression in structure other than that particularly described and illustrated.

DETAILED DESCRIPTION

FIG. 1

Figure 1:
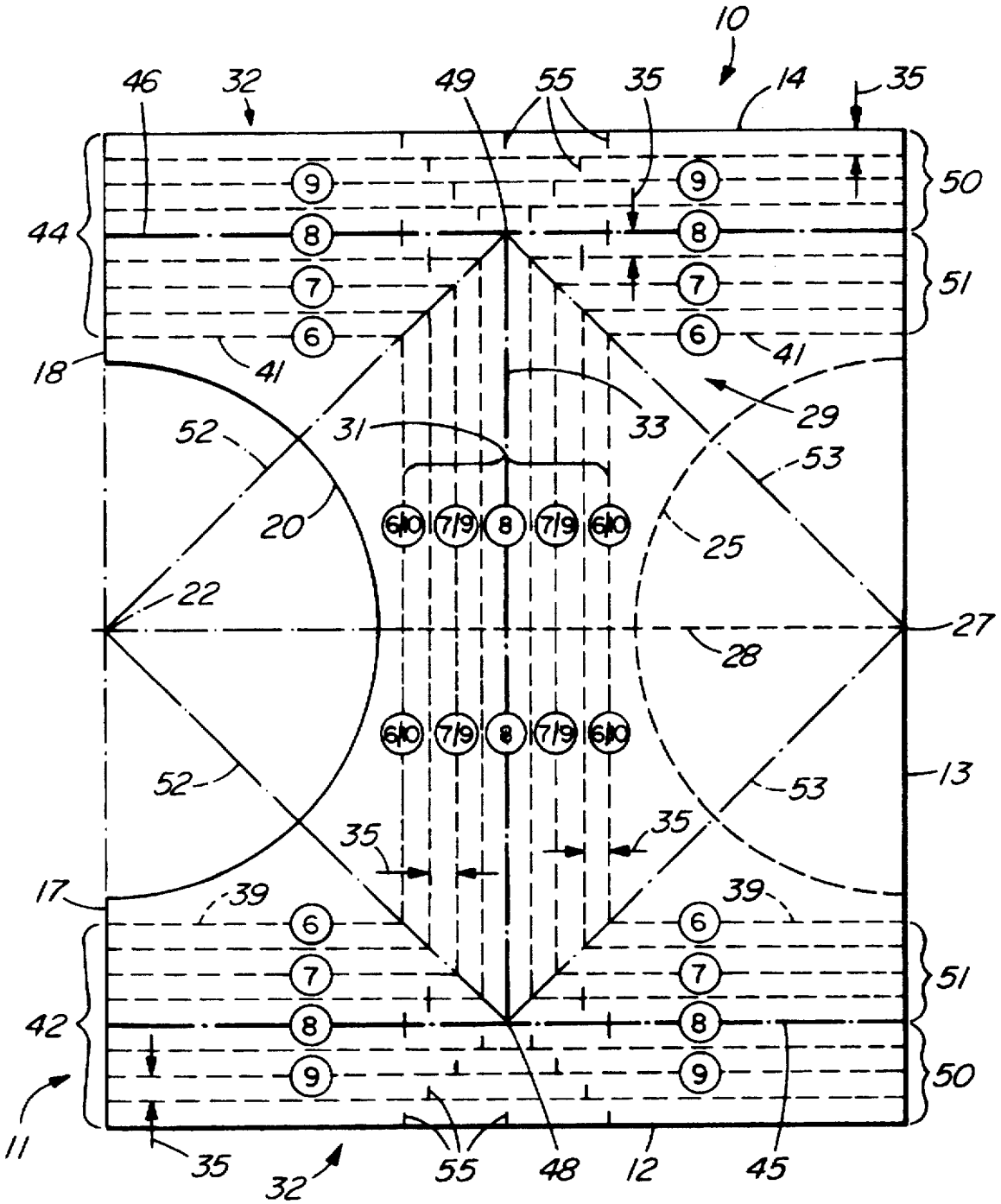
FIG. 1 is a top plan view of a template which is in accordance with a first or preferred embodiment of the invention having a single concave edge portion.

A first embodiment 10 of a template according to the invention is made from a transparent flat sheet of clear plastic, typically acrylic, having a thickness of approximately 0.12 inches (3.0 mm). In the drawings, guidelines actually marked on the template are shown as broken lines with short line portions of equal length within a given line.

In contrast, geometric axes which are not actually marked on the template are shown as chain-dotted lines.

The first embodiment 10 is generally rectangular in shape and has first, second, third and fourth edges designated 11, 12, 13 and 14 respectively. Thus the first and third edges have straight portions that are parallel to each other, the second and fourth edges are straight and parallel to each other, and the first and third, and the second and fourth edges are disposed perpendicularly to each other. The first edge 11 has aligned first and second straight edge portions 17 and 18, and a first concave edge portion 20 intersecting the edge portions 17 and 18 and disposed symmetrically of the second and fourth edges. The concave edge portion 20 is a portion of a first circle, namely a semi-circle, which is concentric with a center 22 located at a mid-point of an axis extending between the first and second straight edge portions 17 and 18. Thus, it can be seen that the second straight edge portion 18 is disposed on a side of the first concave edge portion 20 opposite to the first straight edge portion 17 and the concave edge portion 20 extends over 180 degrees of arc. The first straight edge portion 17 intersects the second edge 12, and the second straight edge portion 18 intersects the fourth edge 14.

The template further comprises a first arcuate guideline 25 which is similar in size and shape to the first concave edge portion 20 and thus is a similar portion of circle centered on a center 27 located at a mid-point of the third edge 13. The term "guideline" refers to any means of providing a relatively thin, clearly visible guideline or marking on the template which is preferably visible from both sides, and can be either screen printed, inscribed, moulded etc., or otherwise marked to provide a permanent marking on the surface. It can be seen that the first arcuate guideline 25 extends over 180 degrees of arc and intersects the third edge 13 at two locations. A transverse template centerline 28 is marked on the template and is aligned with the centers 22 and 27.

The template further includes a grid 29 of first and second sets 31 and 32 respectively of straight guidelines marked on the template. In the first set of straight guidelines, the lines are parallel to each other and parallel to the first and third edges of the template, and are also disposed symmetrically between the first concave edge portion 20 and the first arcuate guideline 25. The first set 31 includes a longitudinal template centerline 33 passing symmetrically between the edge portion 20 and arcuate guideline 25, and about which the first set of lines is disposed symmetrically. Adjacent lines of the first set are spaced laterally apart by a spacing 35, typically about one quarter of an inch (6 mm), which represents one half of a "size increment" of typical quilting squares. A size increment is the difference in size between the next larger or smaller relatively "standard sized" quilting unit and is typically one half of an inch (13 mm).

The second set 32 has a plurality of straight guidelines which are also parallel to each other and parallel to the second and fourth edges of the template. The second set extends as two separate groups, namely groups 42 and 44 of lines, which are generally adjacent the second and fourth edges of the template respectively. The first group 42 is defined by aligned innermost lines 39 and the second edge 12, and the second group 44 is defined by aligned innermost lines 41 and the fourth edge 14 of the template. The first group has a centerline 45 and the second group has a centerline 46, the centerlines being disposed symmetrically of each group and intersecting the longitudinal centerline 33 at main intersections 48 and 49 respectively. Similarly to the first set of lines, adjacent lines in the first and second groups 42 and 44 are also spaced laterally apart by the spacing 35.

Each of the first and second groups 42 and 44 of lines has several outer lines 50 disposed outwardly of respective centerlines 45 and 46 and inwardly of the edges 12 and 14 respectively, the outer lines extending continuously between the first and third edges of the template. In contrast, each of the first and second groups of lines has an equal number of inner lines 51 disposed inwardly of the respective centerlines 45 and 46 and including the innermost lines 39 and 41 respectively. The inner lines 51 intersect opposite ends of lines of the first set of lines 31 at unmarked intersections which define two V-shaped patterns at the said opposite ends disposed symmetrically and adjacent the second and fourth edges. Each set of V-shaped patterns is disposed symmetrically about a respective vertex axis which intersects adjacent vertices of the V-shaped patterns in each set, two such vertex axes being designated 52 and 53. The vertex axes 52 and 53 extend to intersect centers 22 and 27 respectively of the concave edge portions 20 and marked arcuate guideline 25 respectively. By geometry, it can be seen that the spacing between the centerlines 45 and 46 of the second set 32 equals length of the second and fourth edges of the template. Clearly the outer lines 50 of each group of lines 42 and 44 extend a distance outwardly from the adjacent centerline equal to spacing of the innermost line of each group of lines from its center line.

To facilitate use of the template, some of the straight guidelines have been designated with numbers in circles representing length of the side of a particular square of a quilting unit. The example shown in FIG. 1 can be used to produce quilting units from fabric squares having sides ranging from 6 inches to 10 inches, in half inch increments. Consequently, in the second set of guidelines 32, the innermost lines 39 and 41 are marked with numeral 6 to represent a six inch square, and alternating lines are similarly marked with numerals 7, 8 and 9 for squares having sides of 7 inches, 8 inches and 9 inches respectively. Similarly, in the first set of lines 31, the centerline 33 is marked with numeral 8, and alternate sets of lines spaced outwardly from the centerline are marked with numerals 7/9 and 6/10 for designating lines for either 7 inch or 9 inch squares, or 6 inch or 10 inch squares, depending on the alignment of the template with respect to the square, as will be described with reference to FIGS. 2 through 9. While the numerical designations of the guidelines are not essential, they can assist beginners in locating the particular guidelines for alignment with edges of the squares as will be described. In addition, some of the second set of guidelines 32 are marked with short hatch marks 55, which are seen to be aligned with certain of the lines of the first set of lines 31. The hatch marks 55 also assists in accurate location of the template with respect to edges of the square as will be described. Clearly, guidelines could be colour-coded to assist in distinguishing one group of lines from another group of lines.

Operation

FIGS. 2 through 9

The method of using the first embodiment 10 of the invention will now be briefly described, particularly for making four essentially identical quilting units, which are commonly known as "drunkard's path" units.

Figure 2:
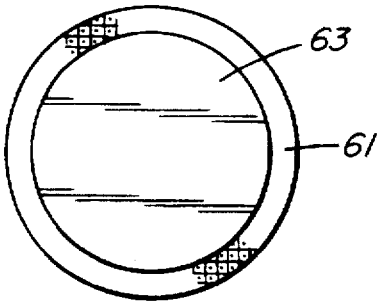
FIGS. 2–9 are simplified sequence diagrams showing use of the preferred embodiment to produce a set of quilting units prior to sewing the units into a quilt.
Figure 3:
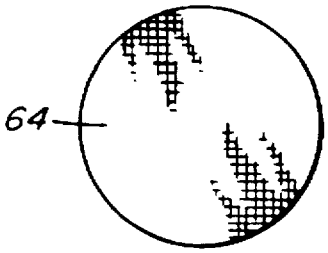

Referring to FIG. 2, by using appropriately sized full circle templates, not shown, a circle 61 of a first fabric is cut from a piece of fabric using a larger sized circle template, and a circle of conventional freezer paper 63 is cut from a sheet of freezer paper using a smaller sized circle template. The difference in size of the circles represents a seam allowance of one quarter inch as is well known. Following conventional practice the freezer paper circle 63 is centered with respect to the fabric circle 61, with the shiny side of the freezer paper facing upwards, and the wrong side of the fabric facing upwards. Using the tip of a hot dry iron, the seam allowance of the fabric is lifted and pressed onto the shiny side of the paper, so that edges of the freezer paper are wrapped over by the seam allowance which bonds to the freezer paper. FIG. 3 depicts the right side of the fabric circle facing upwards and folded about the freezer paper into an accurately shaped circle, and designated 64.

Figure 4:
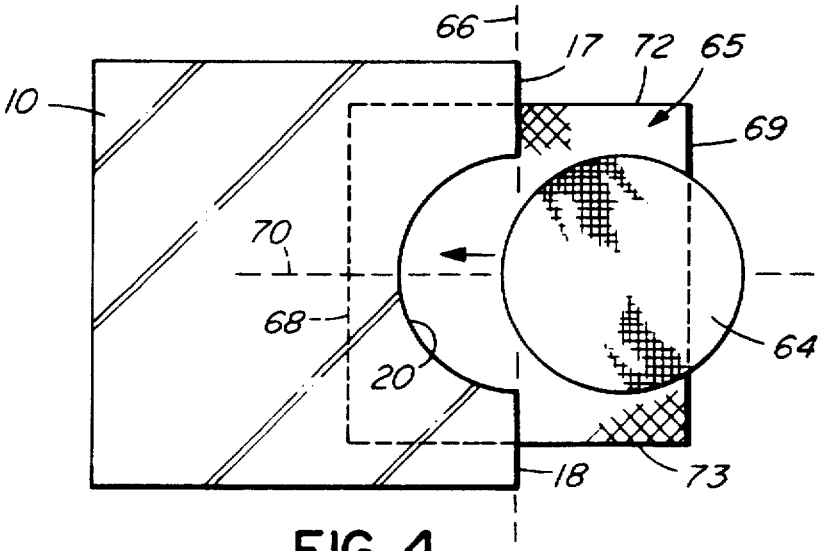

In FIG. 4, a square 65 cut from a second fabric is positioned right side up and partially covered by the template 10, so that the first and second straight edge portions 17 and 18 are aligned with a theoretical vertical centerline 66 of the fabric square of the fabric disposed halfway between edges 68 and 69 of the fabric square. To avoid having to determine location of the centerline 66, the edge 68 is aligned with an appropriate line of the first set of lines 31 marked on the template. Similarly, to ensure the template is disposed symmetrically with respect to a theoretical horizontal centerline 70 of the fabric square, opposite edges 72 and 73 of the fabric square 65 are aligned with appropriate lines of the second set of lines 32. The appropriate line is determined as follows, by referring to FIG. 1. If the fabric square 65 has sides 7 inches long, the edge 68 of the square is aligned with the guideline designated 7/9 of the first set of lines 31 that is closest to the edge portion 20, and the edges 72 and 73 of the square are aligned with the lines designated 7 in the first and second group of lines 42 and 44. Thus, the template 10 is quickly and accurately aligned with the fabric square without folding, marking or other means of determining the centerlines of the square. For squares with sides longer than 8 inches, the guidelines on the side of the centerline 33 remote from the edge portion 20 are aligned with the edge 68 of the fabric square, and the hatch marks 55 are also used to assist in alignment.

Figure 5:
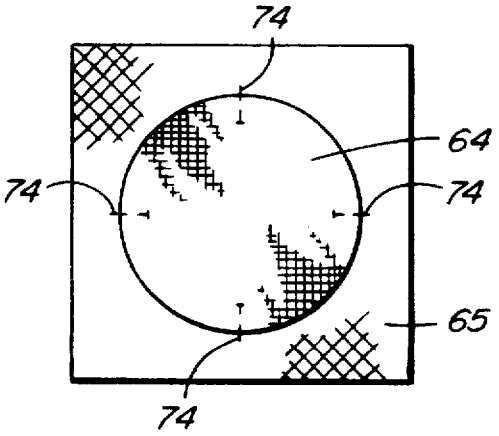

The accurately shaped fabric circle 64 is then positioned right side up against the first concave edge portion 20 of the template, which now ensures that the fabric circle is also centered with respect to the square. Grain of the fabrics of the circle and square are aligned as closely as possible. The fabric circle is now ironed to bond the circle and square together, and the tool is then removed. As shown in FIG. 5, the circle is pinned to the square using several pins 74 so as to maintain accurate location of the circle with respect to the square during sewing. It can be seen that the concave edge portion 20 of the template ensures that the fabric circle is centered accurately with respect to the fabric square without folding either the square or the circle, thus contrasting with one of the prior art methods of centering the circle on the square.

Figure 6:
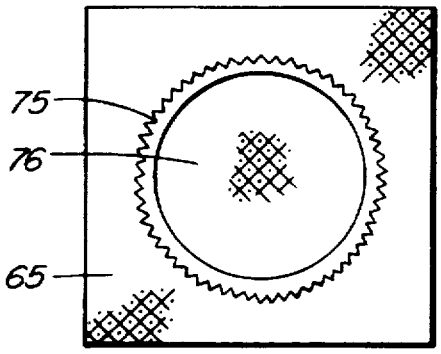

Using a narrow zig-zag stitch 75 and starting where the circle 64 and centerline of the square intersect, the fabric circle 64 is now sewn onto the fabric square in a complete circle to provide a permanent secure attachment for a circle/square assembly. Referring to FIG. 6, the circle/square assembly is then turned upside down to expose the wrong side of the fabric, and a rough reject circle 76, is cut and removed from the second fabric of the square inwardly of the stitches 75 to provide approximately one quarter inch seam allowance. By lifting the edges of the circle fabric with a finger nail, file, etc., the freezer paper can be removed from the assembly. The circle/square assembly can now be ironed to remove any possible unintentional creases.

Figure 7:
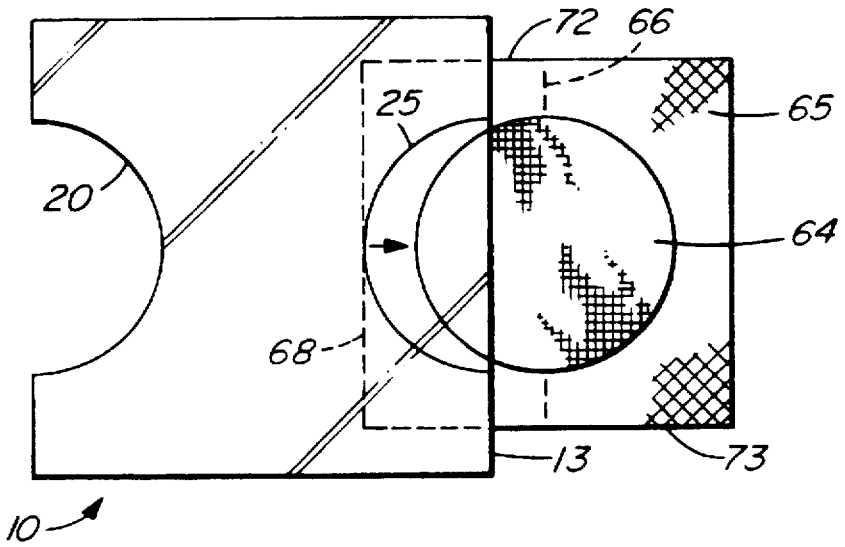
Figure 9:
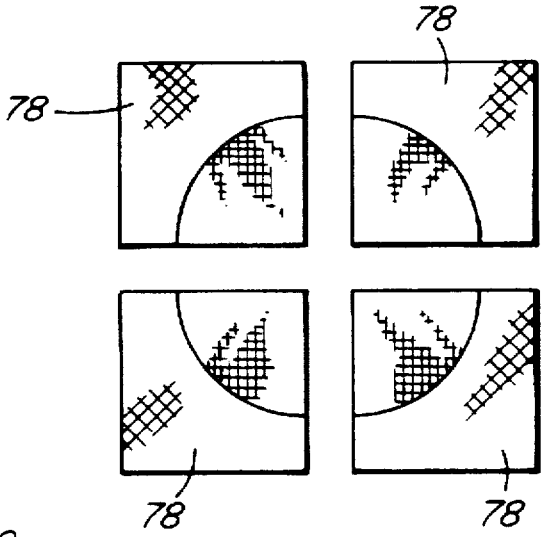
Figure 8:
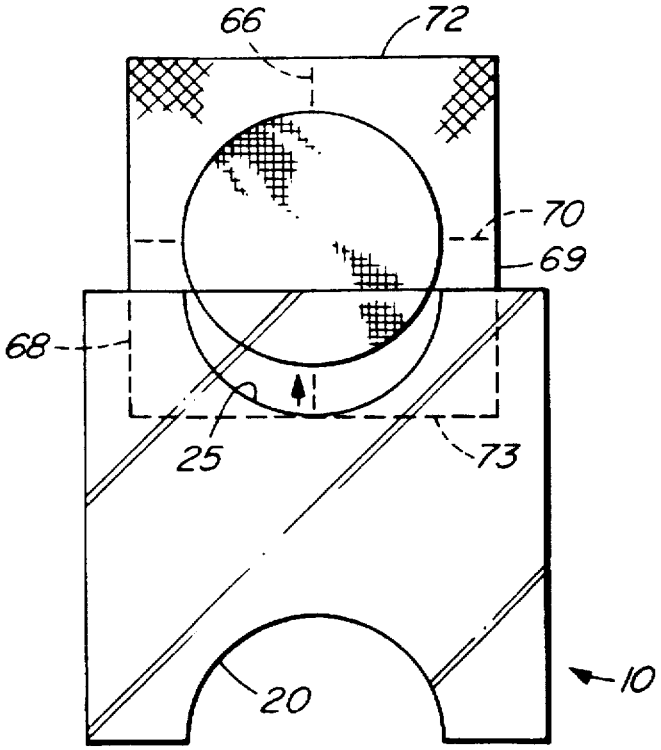
Figure 10:
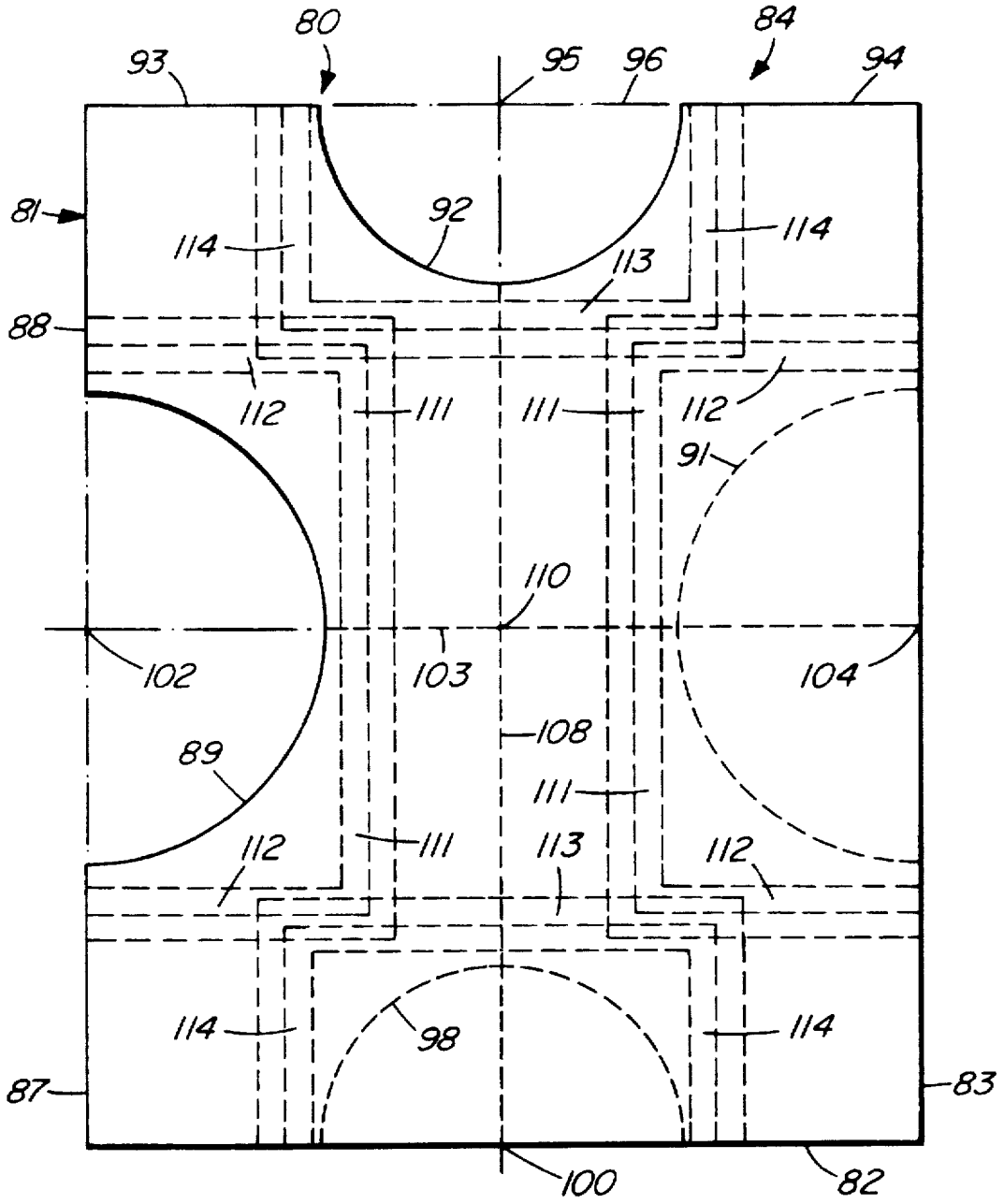
FIG. 10 is a top plan of a second embodiment to the invention showing a template with two dissimilar sized concave edge portions.
Figure 11:
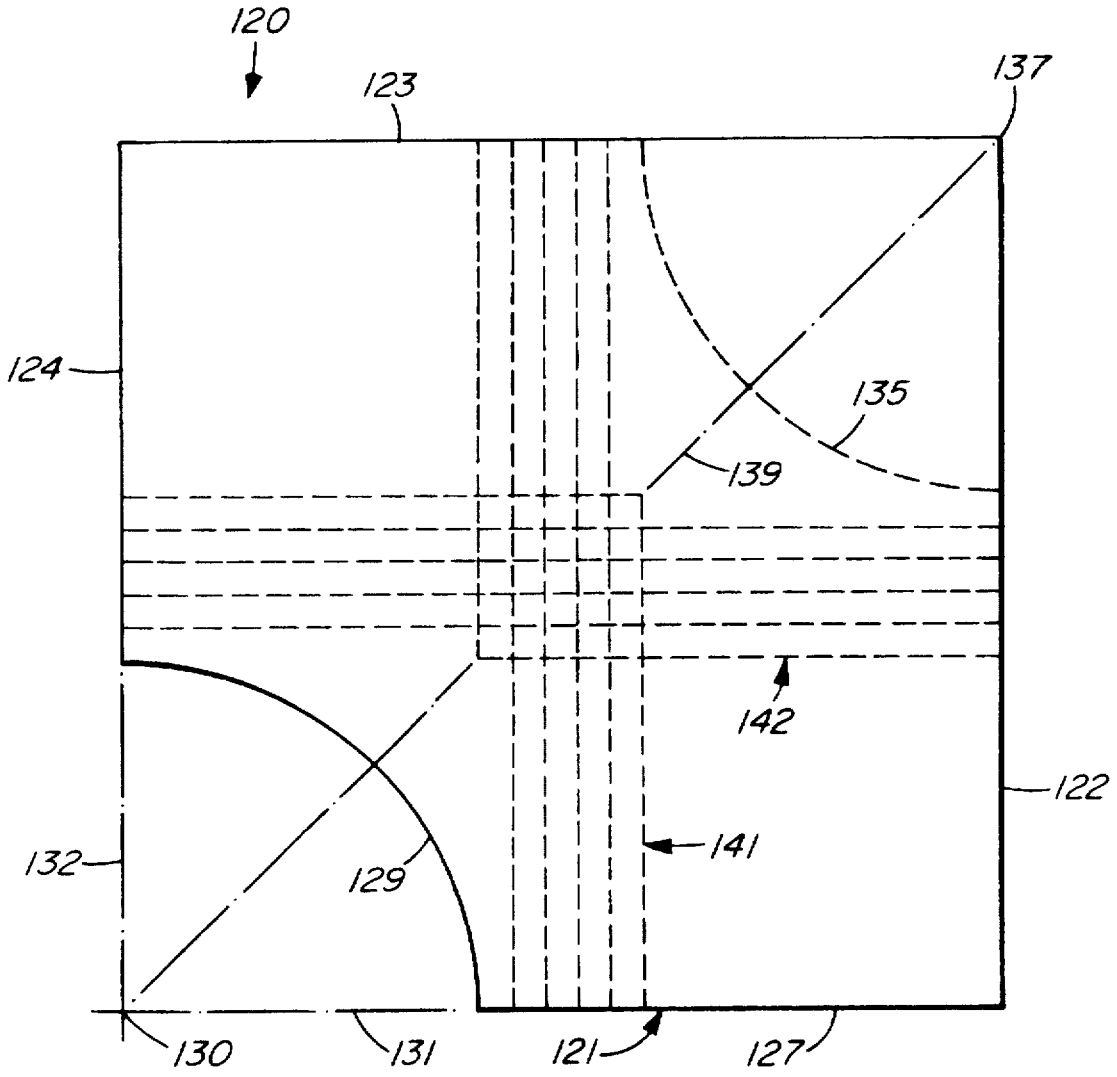
FIG. 11 is a top plan view of a third embodiment of the invention showing a different location of a single concave edge portion.
Figure 12:
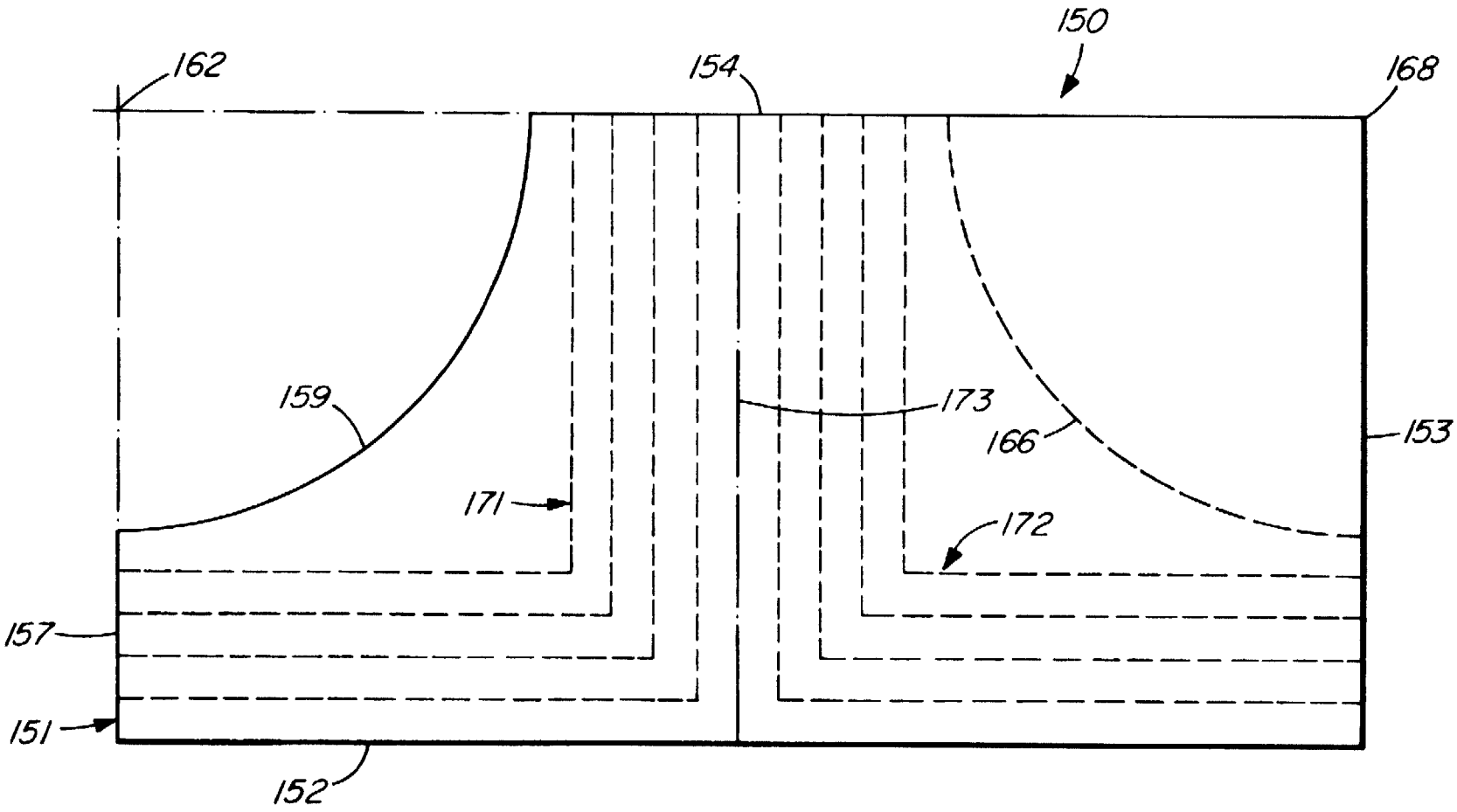
FIG. 12 is a top plan view of a fourth embodiment of the invention showing a further alternative location of a concave edge portion.

FIG. 7 shows an intermediate position when placing the template 10 over the circle/square assembly to provide accurate cutting of the assembly. When the template 10 is correctly positioned over the assembly, the arcuate guideline 25 exactly overlies one-half of the circumference of the accurately shaped circle 64, and the edges 68, 72 and 73 of the square are aligned with appropriate lines of the first and second sets of lines on the template. When in this position, the third edge 13 of the template is aligned with the theoretical vertical centerline 66 of the square. A rotary cutter is then passed carefully and accurately along the third edge 13, so as to cut the circle and square combination in half. Care should be taken to ensure that the two halves of the bisected assembly do not shift, and the template is then rotated 90 degrees as shown in an intermediate position in FIG. 8. The template is then accurately repositioned by overlying one half of the circumference of the circle 64 with the arcuate guideline 25, and aligning the edges 73, 68 and 69 of the square with appropriate lines in the first and second sets of lines respectively of the template. Similarly to the first straight cut, the rotary cutter is passed accurately along the third edge 13, so as to cut each half of the bisected assembly along the centerline 70 to bisect the two halves into four essentially similar "drunkard's path" quilting units 78 as shown in FIG. 9. The units 78 are now ready for sewing into a quilt following conventional procedures.

In summary, it can be seen from the above that the circle 64 is accurately centered on the square 65 using the concave edge portion 20 and first and second sets of guidelines, and the circle and square are then sewn together. The sewn circle/square assembly is then accurately quartered using the arcuate guideline 25 in combination with the third edge 13 and the first and second sets of guidelines. Thus, the concave edge portion facilitates accurate centering of the circle and square prior to sewing, and the arcuate guideline facilitates accurate cutting after sewing. Because the "drunkard's path" units 78 are made more accurately than prior art methods, the resulting quilt is usually also more accurate and geometrically correct than a prior art quilt, and also can be cut and assembled easier and faster than before.

Alternatives

FIG. 10

A second embodiment 80 of the invention has the important aspects of first embodiment 10, plus a second smaller diameter concave edge portion and corresponding similar sized arcuate guideline. This permits the quilter to utilize the smaller reject circles of fabric cut out of second fabric of the square while producing the circle/square assembly with the first embodiment 10.

The second embodiment of the template according to the invention is generally rectangular and has first, second, third and fourth edges 81, 82, 83 and 84 respectively in which the first, second and third edges 81 through 83 resemble the first, second and third edges 11, 12 and 13 of FIG. 1. Thus the first edge 81 has first and second straight edge portions 87 and 88 disposed symmetrically on either side of a first concave edge portion 89. Similarly, the third edge 83 has a first arcuate guideline 91 similar in size and shape to the first concave edge portion 89. In contrast to the embodiment 10, the fourth edge 84 has a second concave edge portion 92 located symmetrically of the fourth edge and extending over 180 degrees of arc to provide two straight edge portions 93 and 94 located on opposite sides of the second concave edge portion. The second concave edge portion 92 is a portion of a second circle of different diameter than the first circle, the second circle having a center 95 intersected by an axis 96 extending between and aligned with the straight edge portions 93 and 94 similarly to the first concave edge portion 89.

The difference between diameters of the first circle corresponding to the portion 89 and the second circle corresponding to the portion 92 is preferably equal to one increment in size for a smaller "standard" circle used in quilting. In other words, if the circle of the portion 89 is 5 inches in diameter, the circle for the portion 92 would be 4 inches in diameter. The reject circles 76 cut in the quilting process described with reference to FIGS. 6 and 7 are typically of this general size, and thus can be used for folding over circles of freezer paper as previously described to produce quilting units with circles smaller than the circle 64, and of the same size as the portion 92. This enables quilters to utilize the small pieces of fabric cut from the squares that otherwise might be wasted. Clearly, one template can therefore be used to produce quilts using quilting units with circles of two different diameters.

Similarly, the template 80 also includes a second arcuate guideline 98 which is similar in size and shape to the second concave edge portion 92 and is located symmetrically of the second edge 82 to intersect the second edge at two locations. The first concave edge portion 89 and the first arcuate guideline 91 are concentric with centers 102 and 104 of respective circles, and a transverse centerline 103 marked on the template is aligned with the centers 102 and 104. Similarly, a longitudinal centerline 108 is marked on the template and is aligned with the centers 95 and 100 of the second concave edge portion 92 and second arcuate guideline 98. The centerlines 103 and 108 intersect at a center 110 of the template and are clearly equivalent to the lines 28 and 33 of FIG. 1.

Similarly to the first embodiment of FIG. 1, the second embodiment 80 has grids of straight guidelines corresponding to the concave edge portion and arcuate guideline of each side of the template. Thus, the template 80 has first and second groups of straight guidelines 111 and 112 relating to the first concave edge portion 89 and first arcuate guideline 91, and similar third and fourth groups of straight guidelines 113 and 114 relating to the second concave edge portion 92 and second arcuate guideline 98. Clearly, the first and second groups of guidelines 111 and 112 can be marked with a different colour from the third and fourth groups of guidelines 113 and 114 to avoid risk of confusion for a beginner using the template.

FIG. 11

A third embodiment 120 of the invention is a template similarly made from a generally rectangular transparent flat sheet and comprises first, second, third and fourth edges 121, 122, 123 and 124 respectively. The first edge has a first straight edge portion 127 and a first concave edge portion 129 which extends over 90 degrees of arc. Thus, the portion 129 is a portion of a circle concentric with a projected intersection 130 of axes 131 and 132 extending from the first and fourth edges 121 and 124 respectively. The third embodiment 120 has a first arcuate guideline 135 which extends over 90 degrees of arc and is concentric with a corner 137 of an intersection of the second and third edges 122 and 123. The third embodiment is symmetrical about a first centerline 139 extending between the intersection 130 and corner 137, i.e. centers of the circles of the first concave edge portion and the first arcuate guideline. Similarly to the first and second embodiment, the arcuate guideline 135 is a portion of a circle of similar size and shape to the first concave edge portion 129.

The third embodiment further includes first and second sets of straight guidelines 141 and 142 respectively disposed symmetrically of the first centerline 139 and arranged in a "chevron-shape" as shown. The first set of straight guidelines includes a plurality of lines generally parallel to the first straight edge portion 127, and a second set of lines generally parallel to the second edge 122, which lines intersect on the center line. Similarly, the second set of straight guidelines include similar sets of lines disposed parallel to the first straight edge portion 127 and the second edge portion 122. The sets of guidelines 141 and 142 function similarly to the first and second sets of lines 31 and 32 of FIG. 1 to facilitate alignment of the concave edge portion 129 and the first arcuate guideline 135 symmetrically of the square of fabric.

FIG. 12

A fourth embodiment 150 of the invention is a template similarly made from a generally rectangular transparent sheet and comprises first, second, third and fourth edges 151, 152, 153 and 154 respectively. The first edge 151 has a first straight edge portion 157 and a first concave edge portion 159. The first concave edge portion extends over 90 degrees of arc and is concentric with a projected intersection 162 of undesignated axes of the first and fourth edges 151 and 154 respectively. The fourth embodiment 150 further includes a first arcuate guideline 166 which extends over 90 degrees of arc and is concentric with a corner 168 at an intersection of the third and fourth edges 153 and 154 respectively. Similarly to the previous embodiments, the first arcuate guideline 166 is a portion of a circle of similar size and shape to the first concave edge portion 159. Similarly to the other embodiments, the fourth embodiment includes first and second sets of straight guidelines 171 and 172 respectively which are disposed symmetrically of a transverse centerline 173 of the template. The sets of lines are in a chevron pattern and are used to facilitate alignment of the template with edges of the square in a manner similar to that as previously described.

From the above, it can be seen that the first arcuate guideline of any of the embodiments intersects an edge of the template in at least one place, on the third edge, and is of a size and shape generally similar to the corresponding concave edge portion of that template. Furthermore, in all embodiments described above, it can be seen that the first arcuate guideline is located relative to an adjacent edge of the template other than the first edge similarly to the location of the first concave edge portion relative to the first straight edge portion of the template. Also, the second and third edges of the template are connected together, not necessarily perpendicularly and cooperate with the first edge.

What is claimed is:

1. A transparent flat sheet template comprising:

(a) a first edge having a first straight edge portion and a first concave edge portion located adjacent each other, the first concave edge portion being a portion of a first circle, (b) second and third edges connected together and cooperating with the first edge, and (c) a first arcuate guideline similar in size and shape to the first concave edge portion, the first arcuate guideline being located relative to an adjacent edge of the template other than the first edge similarly to the location of the first concave edge portion relative to the first straight edge portion of the template.

2. A template as claimed in claim 1, in which:

(a) the second edge is straight and disposed perpendicularly to the first straight edge portion, (b) a fourth straight edge is straight and disposed parallel to the second edge.

3. A template as claimed in claim 1, in which:

(a) the first arcuate guideline intersects an edge of the template in at least one place.

4. A template as claimed in claim 3, in which:

(a) the first arcuate guideline intersects the third edge.

5. A template as claimed in claim 1, in which:

(a) the first straight edge portion intersects the second edge, and (b) the second and third edges are straight and intersect each other perpendicularly.

6. A template as claimed in claim 1, further comprising:

(a) a grid of first and second sets of straight guidelines marked on the template, in which:

(i) the first set of straight guidelines are parallel to each other and to the first straight edge portion of the template, and (ii) the second set of straight guidelines are parallel to each other and to the second edge of the template.

7. A template as claimed in claim 1, in which:

(a) the first concave edge portion and first arcuate guideline are concentric with centers of respective circles, and (b) the template is symmetrical about a first centerline extending between the centers of the circles of the first concave edge portion and the first arcuate guideline.

8. A template as claimed in claim 7, in which:

(a) the first centerline is perpendicular to the first straight edge portion of the first edge.

9. A template as claimed in claim 2, in which:

(a) the first edge has a second straight edge portion aligned with the first straight edge portion and disposed on a side of the first concave edge portion opposite to the first straight edge portion, and (b) the concave edge portion extends over 180 degrees of arc.

10. A template as claimed in claim 9, in which:

(a) the first arcuate guideline extends over 180 degrees of arc and intersects the third edge at two locations.

11. A template as claimed in claim 10, further comprising:

(a) a fourth edge disposed parallel to the second edge and intersecting the first and third edges, (b) a first set of straight guidelines disposed parallel to the first and second straight edge portions of the first edge, and (c) a second set of straight guidelines disposed parallel to the second edge of the template and intersecting the first set of straight guidelines.

12. A template as claimed in claim 10, in which:

(a) the first set of straight guidelines is disposed between the first concave edge portion and the first arcuate guideline.

13. A template as claimed in claim 11, in which:

(a) the second set of straight guidelines extends as two groups of parallel lines located adjacent to the second and fourth edges of the template.

14. A template as claimed in claim 13, in which:

(a) the first and second set of lines intersect each other in a plurality of sets of V-shaped patterns disposed symmetrically and adjacent the second and fourth edges.

15. A template as claimed in claim 14, in which:

(a) each set of the V-shaped patterns is disposed symmetrically about a vertex axis which intersects adjacent vertices of the V-shaped patterns in each set.

16. A template as claimed in claim 15, in which:

(a) the first concave edge portion and the first arcuate guideline are concentric with centers of respective circles, and (b) the vertex axes extend to intersect a center of either the said respective circle of the first concave edge portion or the first arcuate guideline.

17. A template as claimed in claim 11, further comprising:

(a) a second concave edge portion located symmetrically of the fourth edge and extending over 180 degrees of arc to provide two straight edge portions located on opposite sides of the second concave edge portion, the second concave edge portion being a portion of a second circle of different diameter than the first circle, and (b) a second arcuate guideline similar in size and shape to the second concave edge portion and located symmetrically of the second edge to intersect the second edge at two locations.

18. A template as claimed in claim 17, further comprising:

(a) a grid of first and second sets of straight guidelines marked on a template, in which:

(i) the first set of lines are parallel to each other and to the first straight edge portion of the template, and (ii) the second set of lines are parallel to each other and to the second edge of the template, and extend as two groups of parallel lines located adjacent to the second and fourth edges of the template.

19. A template as claimed in claim 2, in which:

(a) a fourth edge is disposed parallel to the second edge, and (b) the first concave edge portion extends over 90 degrees of arc and is concentric with a projected intersection of the first and fourth edges, and (c) the first arcuate guideline extends over 90 degrees of arc and is concentric with a corner at an intersection of the second and third edges.

20. A template as claimed in claim 2, in which:

(a) a fourth edge is disposed parallel to the second edge, (b) the first concave edge portion extends over 90 degrees of arc and is concentric with a projected intersection of the first and fourth edges, and (c) the first arcuate guideline extends over 90 degrees of arc and is concentric with a corner at an intersection of the third and fourth edges.

* * * * *